US006422187B2

(12) United States Patent
Fischer et al.

(10) Patent No.: US 6,422,187 B2
(45) Date of Patent: Jul. 23, 2002

(54) VARIABLE VALVE MECHANISM HAVING AN ECCENTRIC-DRIVEN FRAME

(75) Inventors: Thomas H. Fischer, Rochester, NY (US); William R. Haslett, Hanover, NH (US)

(73) Assignee: Delphi Technologies, Inc., Troy, MI (US)

( * ) Notice: Subject to any disclaimer, the term of this patent is extended or adjusted under 35 U.S.C. 154(b) by 21 days.

(21) Appl. No.: 09/755,364

(22) Filed: Jan. 5, 2001

Related U.S. Application Data

(60) Provisional application No. 60/178,225, filed on Jan. 26, 2000.

(51) Int. Cl.[7] ..... F01L 13/00

(52) U.S. Cl. ..... 123/90.16; 123/90.17; 123/90.6

(58) Field of Search ..... 123/90.15, 90.16, 123/90.17, 90.22, 90.31, 90.39, 90.41, 90.42, 90.43, 90.44, 90.45, 90.6

(56) References Cited

U.S. PATENT DOCUMENTS 5,937,809 A 8/1999 Pierik et al.
5,988,125 A * 11/1999 Hara et al. ..... 123/90.16
5,996,540 A * 12/1999 Hara ..... 123/90.16
6,019,076 A 2/2000 Pierik et al.
6,055,949 A * 5/2000 Nakamura et al. ..... 123/90.16
6,123,053 A * 9/2000 Hara et al. ..... 123/90.16
6,311,659 B1 * 11/2001 Pierik ..... 123/90.24

* cited by examiner

*Primary Examiner*—Weilun Lo
(74) *Attorney, Agent, or Firm*—John VanOphem

(57) ABSTRACT

A variable valve mechanism includes an elongate input shaft having a central axis. An input cam lobe is disposed on the input shaft and is eccentric relative to the central axis. A guide member is pivotally mounted on the input shaft. A frame is disposed in engagement with the input cam lobe, and is pivotally and slidably coupled to the guide member. A link has a first end pivotally coupled to the frame. An output cam is pivotally mounted on the input shaft. The output cam is pivotally coupled to a second end of the link arm. The output cam is configured for oscillating engagement of a roller of a roller finger follower.

9 Claims, 5 Drawing Sheets

VARIABLE VALVE MECHANISM HAVING AN ECCENTRIC-DRIVEN FRAME

CROSS REFERENCE

This application claims the benefit of U.S. Provisional application 60/178,225 filed Jan. 26, 2000.

TECHNICAL FIELD

The present invention relates to variable valve mechanisms of internal combustion engines.

BACKGROUND OF THE INVENTION

Conventional internal combustion engines utilize two throttling devices, i.e., a throttle valve and the intake valves of the engine. The throttle valve is actuated by a driver depressing and/or releasing the gas pedal, and regulates the air flow to the intake valves. The engine intake valves are driven by the camshaft of the engine. The intake valves open and close at predetermined angles of camshaft rotation to allow the descending piston to draw air into the combustion chamber. The opening and closing angles of the valves and the amount of valve lift is fixed by the cam lobes of the camshaft. The valve lift profile (i.e., the curve of valve lift plotted relative to rotation of the camshaft) of a conventional engine is generally parabolic in shape.

Modern internal combustion engines may incorporate more complex and technologically advanced throttle control systems, such as, for example, an intake valve throttle control system. Intake valve throttle control systems, in general, control the flow of gas and air into and out of the cylinders of an engine by varying the timing and/or lift (i.e., the valve lift profile) of the intake valves in response to engine operating parameters, such as, for example, engine load, speed, and driver input. Intake valve throttle control systems vary the valve lift profile through the use of various mechanical and/or electromechanical configurations, generally referred to herein as variable valve mechanisms. Examples of variable valve mechanisms are detailed in commonly-assigned U.S. Pat. No. 5,937,809, the disclosure of which is incorporated herein by reference.

Conventional variable valve mechanisms typically include many component parts, such as link arms, joints, pins and return springs, and are thus relatively complex mechanically. The many component parts increase the cost of the mechanism and make the mechanism more difficult to assemble and manufacture. The joints and pins of a conventional variable valve mechanism are subject to interfacial frictional forces which negatively impact durability and efficiency. The use of return springs negatively impact the durability and limit the operating range of conventional variable valve mechanisms, thereby limiting the operation of the intake valve throttle control system to a correspondingly-limited range of engine operation.

Therefore, what is needed in the art is a variable valve mechanism having fewer component parts, thereby reducing cost and complexity of the mechanism.

Furthermore, what is needed in the art is a variable valve mechanism with fewer joints and/or pins, thereby reducing frictional losses in and increasing the durability of the mechanism.

Moreover, what is needed in the art is a variable valve mechanism that eliminates the use of return springs, thereby increasing the operating range of the mechanism and correspondingly increasing the engine operating range of the intake valve throttle control system.

SUMMARY OF THE INVENTION

The present invention provides a variable valve mechanism for an internal combustion engine.

The invention comprises, in one form thereof, an elongate input shaft having a central axis. An input cam lobe is disposed on the input shaft and is eccentric relative to the central axis. A guide member is pivotally mounted on the input shaft. A frame is disposed in engagement with the input cam lobe, and is pivotally and slidably coupled to the guide member. A link has a first end pivotally coupled to the frame. An output cam is pivotally mounted on the input shaft. The output cam is pivotally coupled to a second end of the link arm. The output cam is configured for oscillating engagement of a roller of a roller finger follower.

An advantage of the present invention is that fewer component parts are used relative to a conventional variable valve mechanism, thereby reducing the cost and complexity of the mechanism.

Another advantage of the present invention is that fewer joints/pins are necessary relative to a conventional variable valve mechanism, thereby reducing friction and increasing durability of the mechanism.

A still further advantage of the present invention is no return springs are used, thereby further increasing the durability of the mechanism and enabling use of the mechanism over a wider range of engine operating conditions.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENTS

Figure 1:
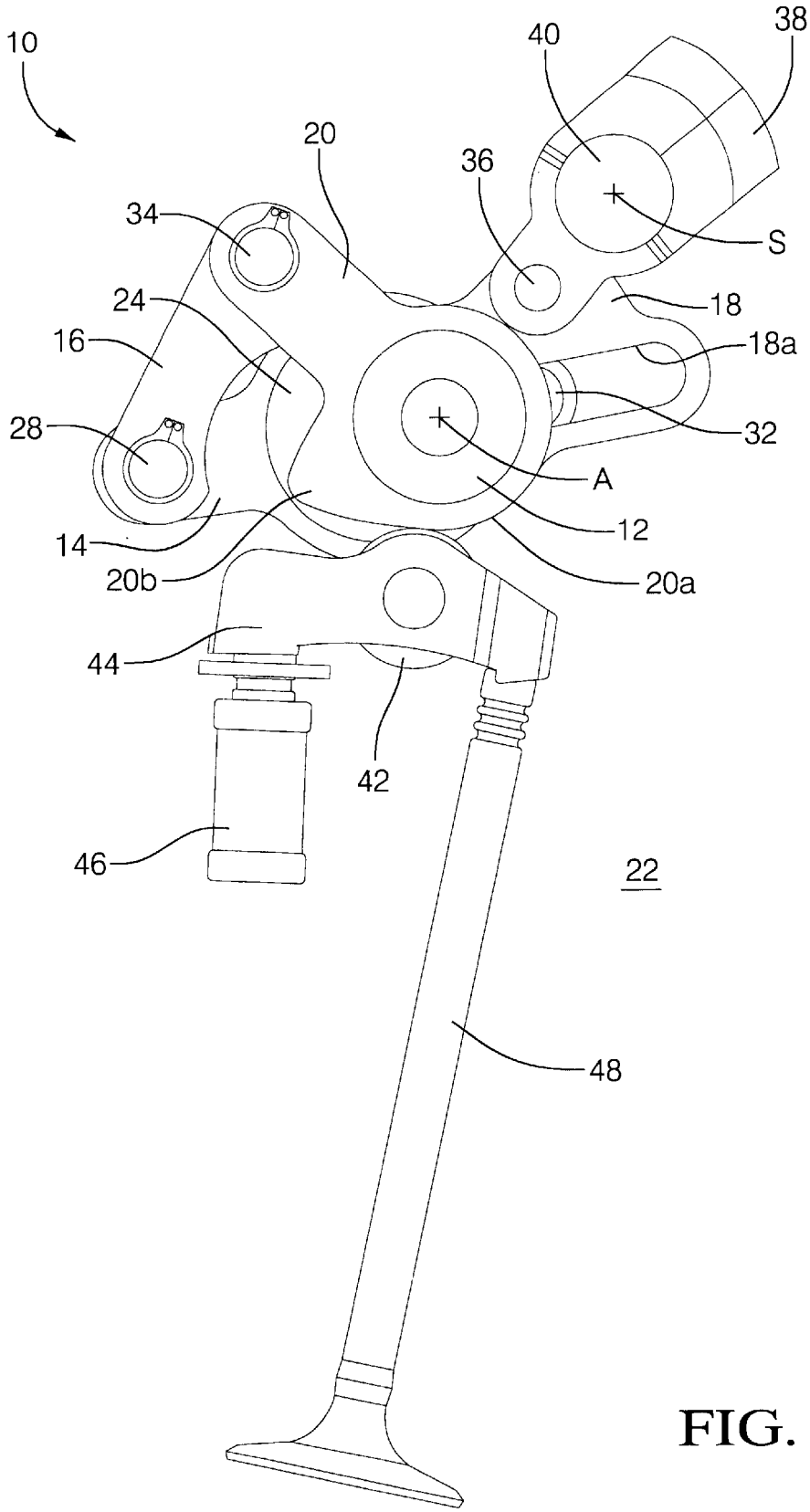
FIG. 1 is side view of one embodiment of a variable valve mechanism of the present invention.
Figure 2:
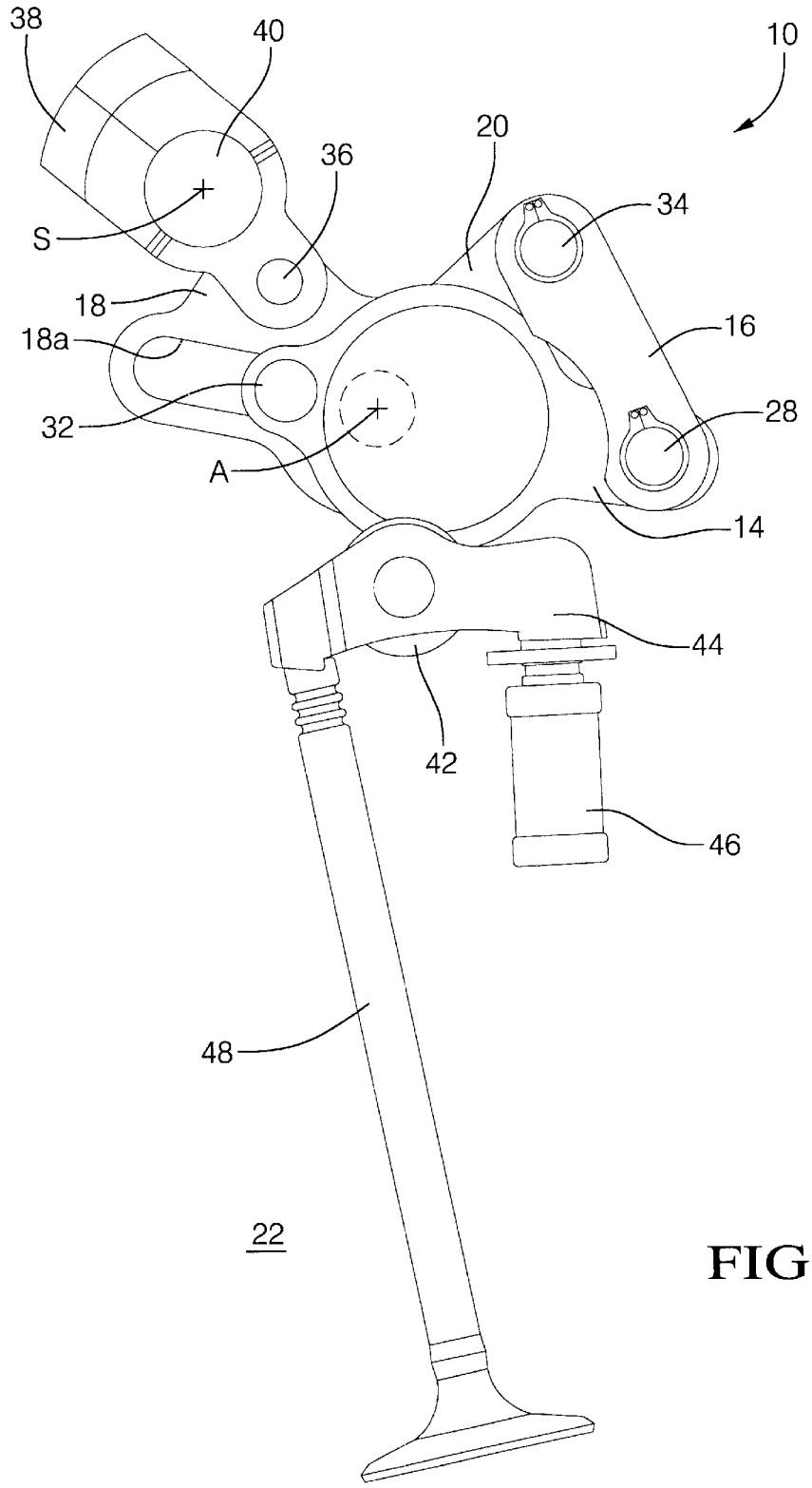
FIG. 2 is an opposite side view of the variable valve mechanism of FIG. 1.

Referring now to the drawings and particularly to FIGS. 1 and 2, there is shown one embodiment of a variable valve mechanism of the present invention. Variable valve mechanism 10 includes input shaft 12, frame 14, link 16, guide member 18, and output cam 20. As will be described more particularly hereinafter, variable valve mechanism 10 selectively varies the duration and lift of an intake valve of an internal combustion engine.

Input shaft 12 is an elongate shaft member, such as, for example, a camshaft. Input shaft 12 has central axis A, and is rotated three-hundred and sixty degrees (360 degrees) around central axis A. Input shaft 12 is driven to rotate in timed relation to the engine crankshaft (not shown), such as, for example, by a camshaft drive, chain, or other suitable means. Input shaft 12 extends the length of the cylinder head (not shown) of multi-cylinder engine 22. A single variable valve mechanism 10 is associated with each cylinder of engine 22. Input shaft 12 includes cam lobe 24 which rotates as substantially one body with input shaft 12. Input cam lobe 24 is, for example, affixed to or integral with input shaft 12. Input cam lobe 24 is eccentric (i.e., non-concentric) relative to central axis A of input shaft 12. Input shaft 12 is received within and extends through each of frame 14, guide member 18 and output cam 20, as is more particularly described hereinafter.

Frame 14 is coupled at generally diametrically-opposed points to link 16 and to guide member 18. More particularly, frame 14 is pivotally coupled to link 16 by link pin 28, and frame 14 is pivotally and slidably coupled to guide 18 by guide pin 32. Frame 14 is disposed around and engages a periphery of input cam lobe 24. Frame 14 is not rotated relative to central axis A by the rotation of input shaft 12. Rather, the rotation of input shaft 12 and input cam lobe 24 is transferred to sliding and pivotal motion of frame 14 as limited and controlled by the coupling of frame 14 to link 16 and to guide member 18, as will be more particularly described hereinafter.

Link 16 is an elongate arm member that is pivotally coupled at one end to frame 14 by link pin 28, and pivotally coupled at the other end to output cam 20 by cam pin 34. Link 16 transfers the sliding and pivoting motion of frame 14 to oscillation of output cam 20 relative to central axis A.

Guide member 18 is mounted on input shaft 12, and is pivotally coupled by shaft pin 36 to control shaft clamp 38. Control shaft clamp 38 is coupled, such as, for example, by clamping, to control shaft 40. Guide member 18 defines guide slot 18*a*, which is generally perpendicular to central axis A of input shaft 12. Guide member 18 is slidable and pivotally coupled to frame 14. More particularly, frame 14 carries guide pin 32 which is slidingly and pivotally received within guide slot 18*a*.

Control shaft 40 is selectively rotated, such as, for example, by an actuator subassembly (not shown) to establish the valve lift profile, as will be more particularly described hereinafter. Control shaft 40 rotates about shaft axis S, which is substantially parallel with and spaced apart from central axis A of input shaft 12.

Output cam 20 is pivotally mounted on input shaft 12, but is not rotated by input shaft 12. Output cam 20 is pivotally coupled to link 16 by cam pin 34. Output cam 20 includes base circle or zero lift portion 20*a* and output cam lobe or lift portion 20*b*. Output cam 20 is oscillated, i.e., rotated from a predetermined angular position relative to central axis A through a predetermined and substantially fixed angle of rotation and back to the predetermined angular position, by the pivotal and sliding motion of frame 14 resulting from the rotation of input cam lobe 24.

In use, input shaft 12 is rotated in timed relation to the engine crankshaft (not shown), such as, for example, by a camshaft drive, chain, or other suitable means. Rotation of input shaft 12 results in the rotation of input cam lobe 24, which is integral with or affixed to input shaft 12. The rotation of input cam lobe 24 is transferred to sliding and pivoting movement of frame 14 as guided and controlled by guide member 18. The pivoting and sliding movement of frame 14 is transferred to link 16 by link pin 28 and, in turn, to oscillation of output cam 20. The predetermined angle through which output cam 20 is oscillated, such as, for example, forty degrees, is determined at least in part by the profile, i.e., the degree of eccentricity, of input cam lobe 24. Output cam 20 engages roller 42 of roller finger follower 44 such that zero lift portion 20*a* and/or output cam lobe 20*b* engages roller 42 as output cam 20 is oscillated. Roller finger follower 44 is pivoted about lash adjuster 46 according to the lift profile of the portion of output cam 20 which engages roller 42. The pivot of roller finger follower 44 actuates valve 48.

The valve lift profile of valve 48 is determined by the rotational proximity or angular position of output cam 20 relative to roller 42. More particularly, the lift profile of valve 48 is determined by the rotational proximity or angular position of output cam lobe 20*b* relative to roller 42. The angular position of output cam 20, and thus of output cam lobe 20*b*, relative to roller 42 is established by the angular position of control shaft 40. Pivotal motion or positioning of control shaft 40 about shaft axis S is transferred through shaft pin 36 to pivotal movement of guide member 18 relative to central axis A. Pivotal movement of guide member 18 is transferred by guide pin 32 to frame 14 which, in turn, is transferred to pivotal movement of output cam 20 relative to central axis A via link pin 28, link 16 and cam pin 34. Thus, the angular position of control shaft 40 establishes the angular position of output cam 20 and output cam lobe 20*b* relative to central axis A and relative to roller 42.

As stated above, a desired valve lift profile is obtained by the rotation of control shaft 40 pivoting output cam 20, and thus output cam lobe 20*b*, about central axis A to thereby establish an angular relation between output cam lobe 20*b* and roller 42. In order to achieve a relatively large amount of valve lift, output cam lobe 20*b* is positioned in relatively close angular relation to roller 42 such that the predetermined angular oscillation of output cam 20 results in a substantial portion of output cam lobe 20*b* engaging roller 42. Valve 48 is lifted or actuated an amount corresponding to the portion of output cam 20 which engages roller 42. Pivoting output cam 20 to establish an angular relation between the peak (not referenced) of output cam lobe 20*b* and roller 42 that is approximately equal to the predetermined angular oscillation of output cam 20 results in substantially the entire lift profile of output cam lobe 20*b* engaging roller 42. Thus, the amount of valve lift of valve 48 is relatively large or substantially maximum.

In order to achieve a relatively small amount of or zero valve lift, output cam 20 is pivoted about central axis A by the pivoting or angular position of control shaft 40 to thereby establish a relatively distant angular relation between the peak of output cam lobe 20*b* and roller 42. Since the peak of output cam lobe 20*b* and roller 42 are relatively distant from each other angularly, the predetermined angular oscillation of output cam 20 results in the zero lift portion 20*a*, or a small lower-lift portion of output cam lobe 20*b*, engaging roller 42. Pivoting output cam 20 to establish an angular relation between the peak of output cam lobe 20*b* and roller 42 that is substantially greater than or outside the predetermined angular oscillation of output cam 20 results in only the zero lift portion 20*a* of output cam 20 engaging roller 42. Thus, the amount of valve lift of valve 48 is relatively small or substantially zero.

Figure 3A:
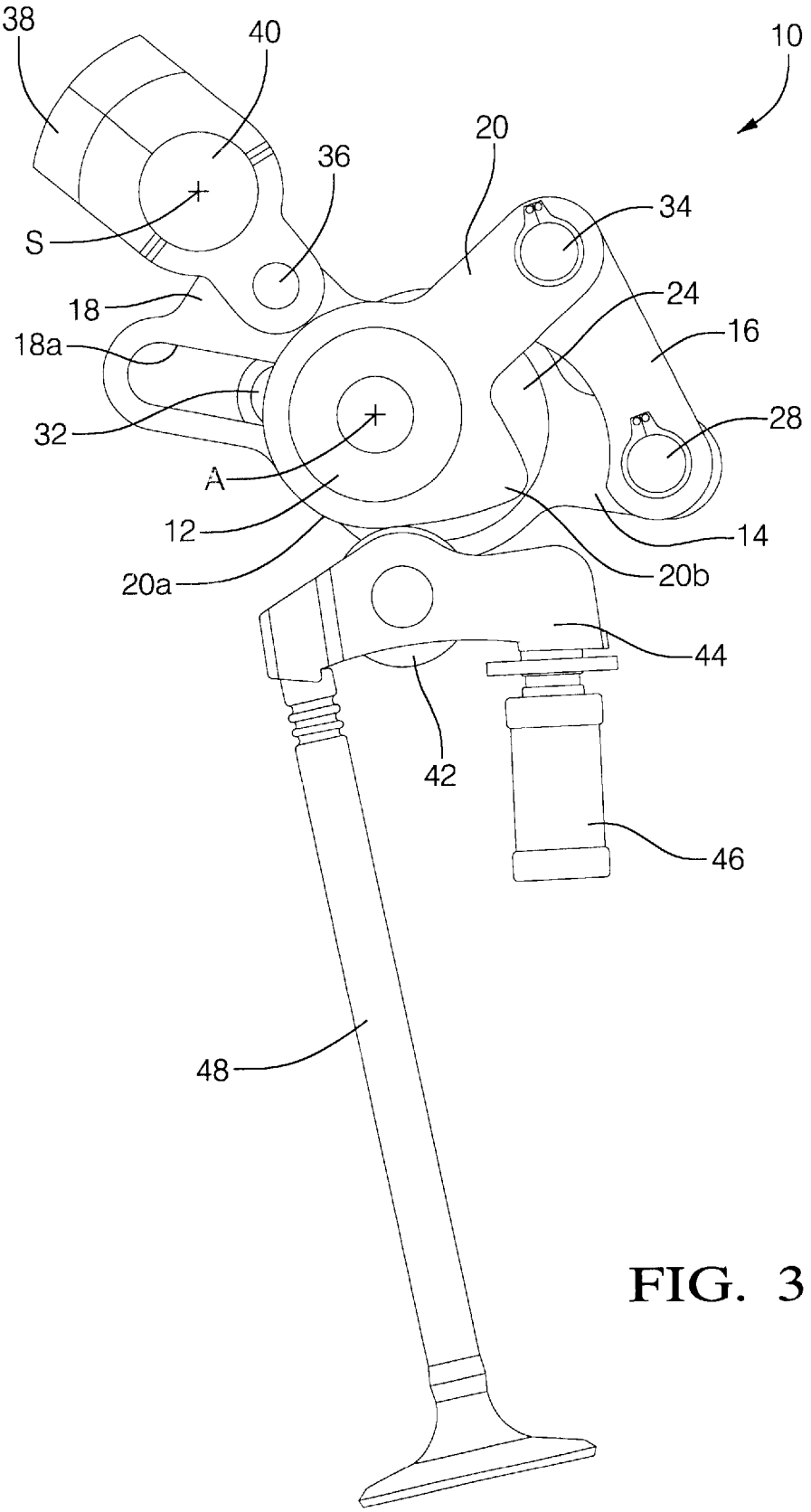
FIG. 3A is a side view of the variable valve mechanism of FIG. 1 with the input cam positioned at zero degrees rotation relative to central axis A.

The above-described operation of variable valve mechanism 10 is illustrated in FIGS. 3A–3D. Referring first to FIG. 3A, variable valve mechanism 10 is shown in a start position or at zero time, and just prior to a valve actuation event. Output cam 20 has been positioned in a predetermined angular relationship relative to central axis A and relative to roller 42 by the pivoting of control shaft 40. Only the base circle or zero lift portion 20*a* of output cam 20 is in engagement with roller 42. The angular position of eccentric input cam lobe 24 of input shaft 12, in turn, places guide pin 32 in its inward-most position within guide slot 18*a* relative to central axis A.

Figure 3B:
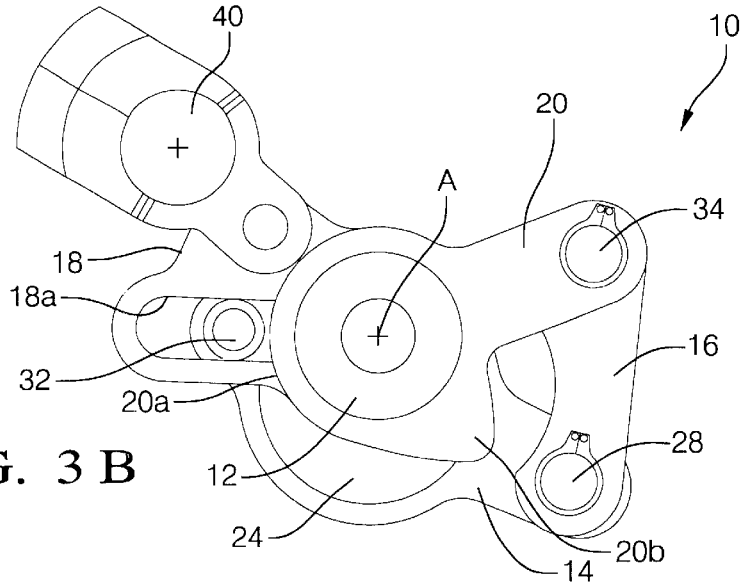
FIG. 3B is a side view of the variable valve mechanism of FIG. 1 with the input cam positioned at ninety degrees rotation relative to central axis A.

Referring now to FIG. 3B, input cam lobe 24 has been rotated approximately ninety-degrees from the position illustrated in FIG. 3A. The rotation of input cam lobe 24 axially slides frame 14 relative to central axis A, thereby sliding guide pin 32 within guide slot 18*a* in an axially-outward direction relative to central axis A. Further, the rotation of input cam lobe 24 pivots frame 14 about central axis A in a clockwise direction relative to central axis A. The clockwise pivoting and sliding of frame 14 is transferred, via link pin 28, link 16 and cam pin 34, to a clockwise pivoting motion of output cam 20. Output cam 20 is thus pivoted clockwise relative to and around central axis A, such that at least a portion of the output cam lobe 20*b* engages roller 42, thereby causing roller finger follower 44 to pivot about lash adjuster 46 and actuate valve 48.

Figure 3C:
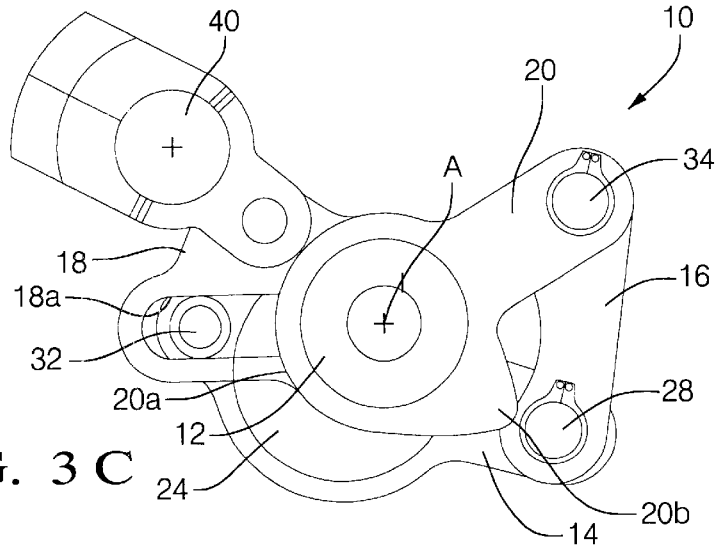
FIG. 3C is a side view of the variable valve mechanism of FIG. 1 with the input cam positioned at one-hundred-fifty degrees rotation relative to central axis A.

Referring now to FIG. 3C, input cam lobe 24 has been rotated approximately one-hundred-fifty degrees from the position illustrated in FIG. 3A. The further rotation of input cam lobe 24 further axially slides frame 14 relative to central axis A, thereby sliding guide pin 32 to an outermost position within guide slot 18*a*, and further pivots frame 14 about central axis A. However, the pivoting of frame 14 about central axis A is now in the counter-clockwise direction. The counter-clockwise pivoting and sliding of frame 14 is transferred, via link pin 28, link 16 and cam pin 34, to a counter-clockwise pivoting motion of output cam 20. Output cam 20 is thus pivoted in a counter-clockwise direction relative to and around central axis A, such that roller 42 is now engaged by a lower-lift portion of output cam lobe 20*b*. Thus, roller finger follower 44 pivots toward the position illustrated in FIG. 3A and valve 48 moves toward a default, for example, closed, position.

Figure 3D:
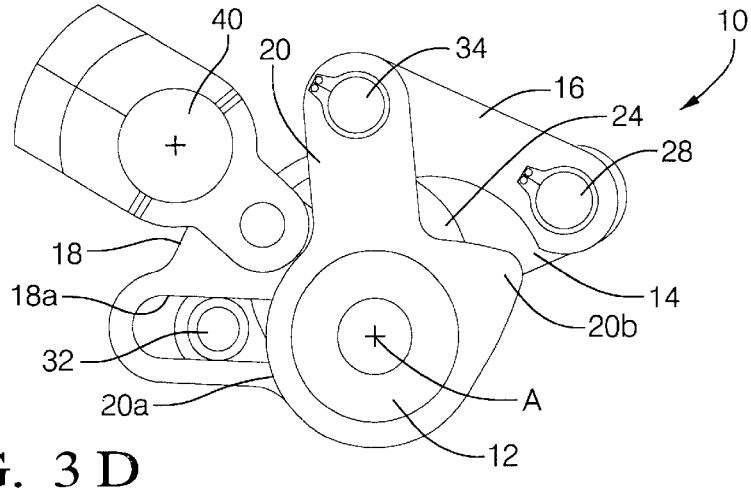
FIG. 3D is a side view of the variable valve mechanism of FIG. 1 with the input cam positioned at approximately two-hundred-seventy degrees rotation relative to central axis A.

Referring now to FIG. 3D, input cam lobe 24 has been rotated approximately two-hundred-seventy degrees from the position illustrated in FIG. 3A. The further rotation of input cam lobe 24 axially slides frame 14 in a direction towards central axis A, and further pivots frame 14 about central axis A in a counter-clockwise direction. The counter-clockwise pivoting and sliding of frame 14 is transferred, via link pin 28, link 16 and cam pin 34, to a counter-clockwise pivoting motion of output cam 20. Output cam 20 is thus further pivoted in a counter-clockwise direction relative to and around central axis A, such that roller 42 is now engaged by only the base circle or zero-lift portion 20*a* of output cam 20. Thus, roller finger follower 44 pivots back to the position illustrated in FIG. 3A and valve 48 returns to the default, or closed, position.

It should be particularly noted that variable valve mechanism 10 does not require any biasing means or springs to reduce mechanical lash. Conventional variable valve mechanisms typically incorporate biasing means, such as springs, to reduce mechanical lash between the mechanism and the rotary or input cam. More particularly, conventional variable valve mechanisms typically employ a roller-type follower, which engages the rotary or input cam, and biasing means or springs to maintain the roller in contact with the rotary cam. In contrast, variable valve mechanism 10 incorporates frame 14 and eccentric cam lobe 24 rather than a roller-type follower. Frame 14 snugly engages cam lobe 24. Thus, mechanical lash is substantially reduced relative to conventional variable valve mechanisms. Further, mechanical lash is controlled by the tolerances between frame 14 and cam lobe 24.

Figure 4:
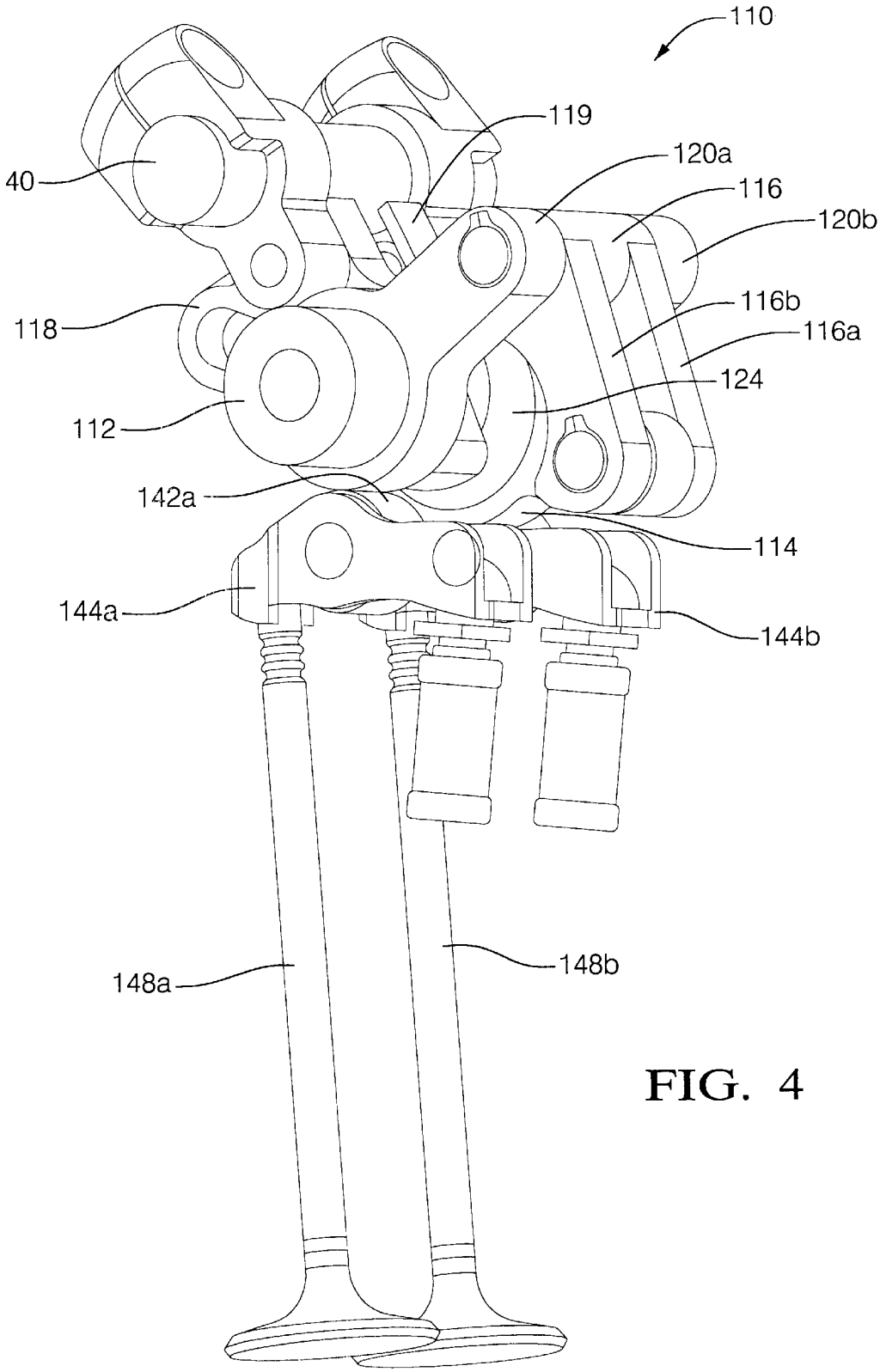
FIG. 4 is a perspective view of a second embodiment of a variable valve mechanism of the present invention.

Referring to FIG. 4, there is shown a second embodiment of a variable valve mechanism of the present invention. Variable valve mechanism 110 is configured for use with an engine having two input valves per cylinder. Variable valve mechanism 110 includes input shaft 112, frame 114, dual link 116, guide members 118 and 119, and output cams 120*a* and 120*b* (only one of which is shown).

Input shaft 112 is substantially identical to input shaft 12 of variable valve mechanism 10, and includes eccentric input cam lobe 124. Frame 114 is mounted on input shaft 112, and snugly engages input cam lobe 124. Frame 114 includes guide pin 132 (not shown). Guide members 118 and 119 are mounted on input shaft 112 and disposed on opposite sides of eccentric input cam lobe 124. Each of guide members 118 and 119 are pivotally coupled to a respective control shaft clamp 138*a* and 138*b*. Each of guide members 118 and 119 define a respective guide slot 118*a* and 119*a* (only one of which is shown). Guide pin 132 is slidingly disposed within each of guide slots 118*a* and 119*a*. Dual Link 116 includes two link arms 116*a* and 116*b*, each of which are pivotally coupled at one end to frame 114 and at the opposite end to output cam 120*a* and output cam 120*b*, respectively. Output cams 120*a* and 120*b* each engage a respective roller 142*a*, 142*b* of roller finger followers 144*a* and 144*b*, respectively, to thereby actuate a corresponding valve 148*a*, 148*b*. The operation of variable valve mechanism 110 and, more particularly, the manner by which the valve lift profile is varied, is substantially similar to the operation of variable valve mechanism 10, as described above.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A variable valve mechanism, comprising:

an elongate input shaft having a central axis, an input cam lobe disposed on said input shaft, said input cam lobe being eccentric relative to said central axis;

a guide member pivotally mounted on said input shaft;

a frame disposed in engagement with said input cam lobe, said frame being pivotally and slidably coupled to said guide member;

a link having a first end and a second end, said first end being pivotally coupled to said frame; and an output cam pivotally mounted on said input shaft, said output cam being pivotally coupled to said second end of said link, said output cam configured for oscillating engagement of a roller of a roller finger follower.

2. The variable valve mechanism of claim 1, further comprising a control shaft, said control shaft being coupled to said guide member such that rotation of said control shaft pivots said guide member relative to said central axis.

3. The variable valve mechanism of claim 2, further comprising a control shaft clamp, said control shaft clamp coupling said control shaft to said guide member.

4. The variable valve mechanism of claim 1, further comprising a link pin, said link pin pivotally coupling said first end of said link to said frame member.

5. The variable valve mechanism of claim 1, wherein said guide member defines a guide slot, said frame carrying a guide pin, said guide pin being slidably and pivotally disposed within said guide slot to thereby slidably and pivotally couple said frame to said guide member.

6. The variable valve mechanism of claim 1, further comprising a cam pin, said cam pin pivotally coupling said second end of said link to said output cam.

7. The variable valve mechanism of claim 1, wherein said frame is coupled to said link at a first point, said frame being coupled to said guide member at a second point, said first point being substantially diametrically opposed to said second point relative to said input shaft.

8. A variable valve mechanism, comprising:

an elongate input shaft having a central axis, an input cam lobe disposed on said input shaft, said input cam lobe being eccentric relative to said central axis;

a first guide member pivotally mounted on said input shaft on a first side of said input cam;

a second guide member pivotally mounted on said input shaft on a second side of said input cam, said second side being opposite said first side;

a frame disposed in engagement with said input cam lobe, said frame being pivotally and slidably coupled to each of said first guide member and said second guide member;

a dual link having a first end and a second end, said first end being pivotally coupled to said frame; and a first output cam pivotally mounted on said first side of said input shaft, said first output cam being pivotally coupled to said second end of said link, said first output cam configured for oscillating engagement of a roller of a first roller finger follower; and a second output cam pivotally mounted on said second side of said input shaft, said second output cam pivotally coupled to said second end of said link, said second output cam configured for oscillating engagement of a roller of a second roller finger follower.

9. An internal combustion engine having a variable valve mechanism, said variable valve mechanism comprising:

an elongate input shaft having a central axis, an input cam lobe disposed on said input shaft, said input cam lobe being eccentric relative to said central axis;

a guide member pivotally mounted on said input shaft;

a frame disposed in engagement with said input cam lobe, said frame being pivotally and slidably coupled to said guide member;

a link having a first end and a second end, said first end being pivotally coupled to said frame; and an output cam pivotally mounted on said input shaft, said output cam being pivotally coupled to said second end of said link, said output cam configured for oscillating engagement of a roller of a roller finger follower.

* * * * *